US010352164B2

(12) United States Patent
Lehnert et al.

(10) Patent No.: US 10,352,164 B2
(45) **Date of Patent: *Jul. 16, 2019**

(54) BIT HOLDER AND BASE PART FOR RECEIVING A BIT HOLDER

(71) Applicant: Wirtgen GmbH, Windhagen (DE)

(72) Inventors: Thomas Lehnert, Oberraden (DE); Karsten Buhr, Willroth (DE); Cyrus Barimani, Konigswinter (DE)

(73) Assignee: Wirtgen GmbH (DE)

( * ) Notice: Subject to any disclaimer, the term of this patent is extended or adjusted under 35 U.S.C. 154(b) by 310 days.

This patent is subject to a terminal disclaimer.

(21) Appl. No.: 15/144,512

(22) Filed: May 2, 2016

(65) Prior Publication Data

US 2016/0356156 A1 Dec. 8, 2016

Related U.S. Application Data

(63) Continuation of application No. 14/278,390, filed on May 15, 2014, now Pat. No. 9,334,733, which is a (Continued)

(30) Foreign Application Priority Data

Dec. 17, 2009 (DE) ..... 10 2009 059 189

(51) Int. Cl.
*E21C 35/19* (2006.01)
*E21C 35/193* (2006.01)
(Continued)

(52) U.S. Cl.
CPC ..... *E21C 35/193* (2013.01); *B28D 1/188* (2013.01); *E01C 23/088* (2013.01); *E21C 35/18* (2013.01);
(Continued)

(58) Field of Classification Search
CPC ..... E21C 35/19; E21C 35/193
See application file for complete search history.

(56) References Cited

U.S. PATENT DOCUMENTS 2,452,081 A * 10/1948 Sullinger ..... E21C 35/193 175/383
2,872,172 A * 2/1959 Fitzgerald ..... E21C 35/1936 299/103
(Continued)

FOREIGN PATENT DOCUMENTS

DE 2940288 A1 5/1980
DE 4322401 A1 1/1995
DE 202007013350 U1 3/2008

*Primary Examiner* — Janine M Kreck
(74) *Attorney, Agent, or Firm* — Lucian Wayne Beavers; Patterson Intellectual Property Law, PC

(57) ABSTRACT

The invention relates to a bit holder having an insertion projection and having a holding projection having a bit receptacle, the insertion projection comprising a bearing segment and the holding projection comprising a supporting segment. In order to allow the bit holder to be braced in permanent and stable fashion with respect to a base part, provision is made according to the present invention that the supporting segment and/or the bearing segment comprise two supporting surfaces and bearing surfaces, respectively, arranged at an angle to one another; and that the longitudinal center axis of the bit receptacle and the longitudinal axis of the insertion projection enclose an obtuse angle.

21 Claims, 5 Drawing Sheets

Figure 1:
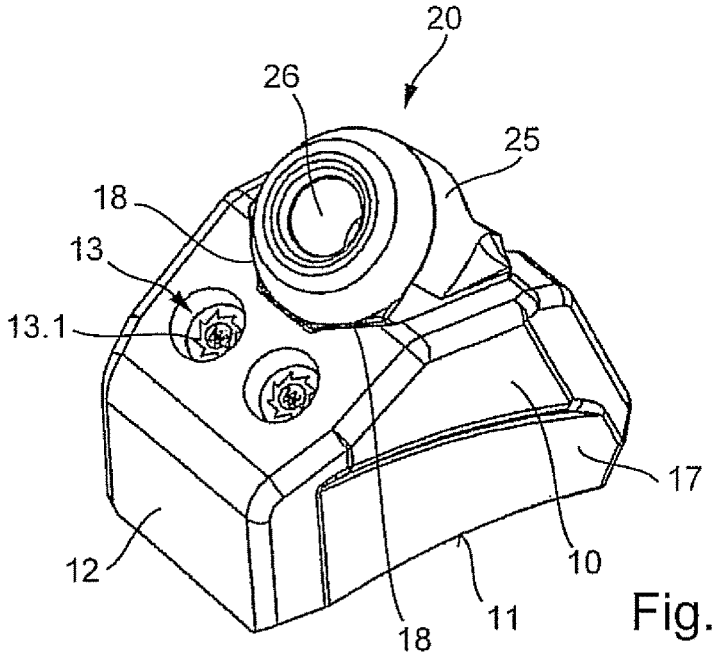

Related U.S. Application Data continuation of application No. 12/960,765, filed on Dec. 6, 2010, now Pat. No. 8,746,807.

(51) Int. Cl.

| | |
|---|---|
| ***E21C 35/18*** | (2006.01) |
| ***B28D 1/18*** | (2006.01) |
| ***E01C 23/088*** | (2006.01) |
| *E02F 9/28* | (2006.01) |

(52) U.S. Cl.

CPC ..... *E02F 9/2866* (2013.01); *E21C 2035/191* (2013.01)

(56) References Cited

U.S. PATENT DOCUMENTS

| | | | | | |
|---|---|---|---|---|---|
| 2,933,295 | A * | 4/1960 | Rollins | E21C 35/1936 | 299/103 |
| 2,950,096 | A * | 8/1960 | Bruestle | E21C 35/18 | 175/383 |
| 3,498,677 | A * | 3/1970 | Morrow | E21C 35/1933 | 279/103 |
| 3,992,061 | A | 11/1976 | Rollins | | |
| 4,240,669 | A * | 12/1980 | Rollins | E21C 35/1933 | 299/102 |
| 4,275,929 | A | 6/1981 | Krekeler | | |
| 4,542,943 | A | 9/1985 | Montgomery, Jr. | | |
| 4,693,518 | A * | 9/1987 | Sulosky | E21C 35/1933 | 299/102 |
| 4,915,455 | A | 4/1990 | O'Neill et al. | | |
| D336,481 | S | 6/1993 | Silvia | | |
| 5,322,351 | A | 6/1994 | Lent | | |
| 5,378,050 | A * | 1/1995 | Kammerer | E21C 35/193 | 299/102 |
| 5,683,144 | A | 11/1997 | Kammerer et al. | | |
| 6,234,579 | B1 * | 5/2001 | Montgomery, Jr. | E21C 35/19 | 299/102 |
| 6,244,665 | B1 | 6/2001 | Bise et al. | | |
| D447,028 | S | 8/2001 | Wikle et al. | | |
| D460,769 | S | 7/2002 | Sollami | | |
| 6,764,140 | B2 | 7/2004 | Carson, Jr. et al. | | |
| D507,166 | S | 7/2005 | Chen | | |
| D520,324 | S | 5/2006 | Yaksich et al. | | |
| 7,300,115 | B2 | 11/2007 | Holl et al. | | |
| D567,270 | S | 4/2008 | Chiang | | |
| D587,086 | S | 2/2009 | Busschaert et al. | | |
| D587,978 | S | 3/2009 | Aglassinger | | |
| D591,577 | S | 5/2009 | Busschaert et al. | | |
| 7,784,875 | B2 | 8/2010 | Holl et al. | | |
| D638,453 | S | 5/2011 | Buhr et al. | | |
| 8,746,806 | B2 * | 6/2014 | Lehnert | E02F 9/2816 | 299/102 |
| 8,746,807 | B2 * | 6/2014 | Lehnert | E21C 35/18 | 299/102 |
| 9,334,733 | B2 * | 5/2016 | Lehnert | E21C 35/18 | |
| 2006/0119165 | A1 | 6/2006 | Holl et al. | | |
| 2008/0093912 | A1 | 4/2008 | Willoughby | | |
| 2009/0085396 | A1 | 4/2009 | Chiang | | |
| 2009/0289493 | A1 | 11/2009 | Holl et al. | | |

* cited by examiner

BIT HOLDER AND BASE PART FOR RECEIVING A BIT HOLDER

The invention relates to a bit holder having an insertion projection and having a holding projection having a bit receptacle, the insertion projection comprising a bearing segment and the holding projection comprising a supporting segment.

The invention further relates to a base part for receiving a bit holder, having an insertion receptacle, a projection, and a supporting projection, the supporting projection forming an abutment having at least one supporting surface, and the projection forming a countermember having at least one supporting surface.

DE 43 22 401 A1 (corresponding to U.S. Pat. No. 5,683, 144) discloses a bit holder changing system having a base part and a bit holder. The base part comprises a supporting foot with which it can be welded onto the outer circumference of a milling drum. An insertion receptacle is introduced into the base part. The insertion receptacle opens into a recess. A supporting surface adjoins the recess at an angle, and oppositely to the tool feed direction. A bit holder can be installed in the base part. The bit holder possesses an insertion projection that can be inserted into the insertion receptacle of the base part. In the installed state, the bit holder is braced with a countersurface against the supporting surface of the base part. A compression screw is used to immobilize the bit holder in the base part. This screw acts on the insertion projection of the bit holder and pulls it into the insertion receptacle. At the same time, the effective direction of the draw-in force is designed so that the insertion projection is pressed, with a prism-shaped front surface, into a prismatic guide of the base part. This results in centered alignment of the bit holder with respect to the base part.

A point-attack bit can be installed in the bit holder. Said bit absorbs forces during operational use, and conveys them into the bit holder. The forces are then conveyed from the bit holder into the base part, the majority of the forces being directed via the stop connection formed between the countersurface and the supporting surface. A certain force component is furthermore dissipated into the contact surfaces created by the prism surfaces.

Bit holder changing systems of this kind serve for utilization when removing road surfaces. Bit holder changing systems are also increasingly in demand for surface mining, where excellent tool rigidity and tool strength is required in a context of high machine performance and high advance speeds.

It is an object of the invention to make available a bit holder, and a base part for receiving a bit holder, that enable long-lasting and rigid bracing of the bit holder with respect to the base part even under high stress.

The object relating to the bit holder is achieved in that the supporting segment of the holding projection and/or the bearing segment of the insertion projection comprise two supporting surfaces and bearing surfaces, respectively, arranged at an angle to one another, the longitudinal center axis of the bit receptacle and the longitudinal axis of the insertion projection enclosing an obtuse angle. The result is that with the supporting segment and bearing segment, respectively, a supporting region is formed through which the transverse loads occurring during tool use can be optimally dissipated. In addition, defined and unequivocally statically determined abutment zones, which enable reproducible zero-clearance installation of the bit holder, are created by means of the supporting surface or surfaces and the bearing surface or surfaces. Improved force dissipation and a more rigid design are made possible by the fact that the bit receptacle and the insertion projection are at an obtuse angle to one another.

According to a preferred variant embodiment of the invention, provision can be made that the supporting segment holds the supporting surface or surfaces at least locally in front of the insertion projection in the tool feed direction, and/or the bearing surface or surfaces are oriented substantially oppositely to the tool feed direction. The variation in force direction during tool use is thereby taken into account. Whereas forces are intercepted more via the front-side supporting surface or surfaces at the beginning of tool engagement into the material to be removed, as tool engagement proceeds further, a force load occurs increasingly on the bearing surface or surfaces that are oriented oppositely to the tool feed direction. This alignment of the supporting and bearing surfaces thus enables load-optimized design of the bit holder.

If provision is made, in the context of a bit holder according to the present invention, that the bearing surface or surfaces comprise(s) surface regions that are arranged in the direction of the longitudinal axis of the insertion projection with an offset from the supporting surface or surfaces, the spacing then creates a lever by means of which moments can reliably be discharged.

A conceivable inventive alternative is such that the insertion projection comprises, on its insertion projection front side facing in the tool feed direction, at least one pressure surface for impingement with a screw, the pressure surface being at an angle to the longitudinal axis of the insertion projection. A draw-in force can be introduced into the insertion projection by way of the screw. Because the screw acts on the front side of the insertion projection, the bit holder can be guided into its installed position oppositely to the tool feed direction and held there, so that it is optimally braced at the rear.

A preferred embodiment of the invention is such that the supporting surface or surfaces face toward the free end of the insertion projection. The loading forces, which act more toward the free end of the insertion projection at the beginning of tool engagement, can thereby be reliably discharged. Provision can especially be made in this context for the supporting surface or surfaces to extend substantially parallel to the longitudinal center axis of the bit receptacle.

If a bit holder is configured in such a way that the holding projection comprises a region that is cantilevered out beyond the insertion projection, and that the supporting surface or surfaces is/are arranged on the cantilevered region, a load-optimized conformation of the bit holder then becomes possible. Because the supporting surface or surfaces are arranged on the cantilevered region of the holding projection, they can reliably support it and moreover are arranged close to the force input point produced by the point-attack bit that is used. A reduction in load moments thereby becomes possible.

With increasing tool feed, the resulting force direction changes. Whereas the force direction is oriented more in a radial direction at the beginning of tool engagement, with increasing tool engagement it will rotate in a direction opposite to the feed direction. In order to allow reliable absorption of the resulting forces produced in this context, provision can be made in this context for the bearing surface(s) to extend locally, in the direction of the longitudinal axis of the insertion projection, beyond the supporting surface or surfaces, and/or for the bearing surface(s) to be guided in the direction of the longitudinal axis into the region of the holding projection.

A simple physical design results in particular from the fact that the bearing surface(s) extend(s) parallel to the longitudinal axis of the insertion projection or extend(s) substantially in the direction of said longitudinal axis.

A preferred configuration of the invention is such that the supporting surface or surfaces and the bearing surface or surfaces respectively form slide guides. Upon installation of the bit holder, it can be placed with its supporting surfaces on countersurfaces of a base part. The bit holder is then clamped against a base part, in which context it can be displaced steplessly in its slide guide into the specified position. This ensures defined and reliable installation. The slide guide thus serves to guide the bit holder into its specified installed position. In the installed position, the bit holder is fixedly joined to the base part so that no further relative motion between these components is possible.

The bit holders are replaceable parts that preferably can be mounted onto the corresponding base parts at various positions on a milling drum. To ensure that reliable force dissipation always occurs in the different mounting positions, provision is made according to an embodiment of the invention for the bearing surfaces and/or supporting surfaces to be arranged respectively on both sides of the transverse central plane of the bit holder extending in the tool feed direction, and/or to be arranged symmetrically with respect to said transverse center plane.

A preferred configuration of the invention is such that the supporting surface or surfaces extend substantially parallel to the longitudinal center axis of the bit receptacle, or that an obtuse angle in the range between ≥0 degrees and 20 degrees is enclosed between the longitudinal center axis of the bit receptacle and the supporting surface or surfaces. The supporting surface or surfaces can thus be guided to a point close to the bit receptacle, thereby resulting in a compact design.

It has been shown that, in particular in a context of deep cutting engagements into the material to be removed, sufficient bit holder rigidity is produced if provision is made that the obtuse angle between the longitudinal center axis of the bit receptacle and the longitudinal axis of the insertion projection is selected in the range between 110 degrees and 160 degrees.

For reliable interception of the force directions that change during cutting engagement, provision is preferably made that the supporting surface or surfaces and the bearing surface or surfaces are oriented in directions facing oppositely to one another, in particular are located diametrically opposite one another.

The object of the invention is also achieved with a base part for receiving a bit holder that comprises an insertion receptacle, a projection, and a supporting projection. The supporting projection forms an abutment having a supporting surface or several supporting surfaces. The projection creates a countermember that comprises a further supporting surface or surfaces. Provision is made according to the present invention that the supporting projection comprises two supporting surfaces and/or the projection comprises two further supporting surfaces, and that the supporting surfaces and/or the further supporting surfaces are incident in prism-shaped fashion at an angle to one another, and that the supporting surface or surfaces enclose(s) an obtuse angle with the longitudinal center axis of the insertion receptacle. As already mentioned above in conjunction with the bit holder, the transverse forces that occur can be optimally dissipated by way of the prism-shaped supporting surfaces or prism-shaped further supporting surfaces. The arrangement of the supporting surface(s) at an obtuse angle to the longitudinal center axis of the insertion receptacle enables optimum force dissipation and a compact design.

Advantageously, the supporting projection is oriented in front of the longitudinal axis of the insertion receptacle in the tool feed direction, and the projection behind the longitudinal axis of the insertion receptacle in the tool feed direction. The supporting surface(s) and further supporting surface(s) are thus also held respectively before and behind said longitudinal axis. This distribution of the supporting surfaces creates a lever arm which reduces the load moments that occur. Advantageously, the further supporting surface(s) of the projection has/have surface regions that are arranged at least locally with an offset, transversely to the tool feed direction, with respect to the supporting surface(s) of the supporting projection.

A conceivable variant of the invention is such that the supporting surface or surfaces of the supporting projection extend at an obtuse angle with respect to the longitudinal axis of the insertion receptacle and/or face oppositely to the tool feed direction. This alignment of the supporting surface(s) enables an optimum force path at the beginning of tool engagement into the material to be removed.

In order to hold the bit holder securely in the base part, provision can be made for the supporting projection to comprise at least one screw receptacle that opens into the insertion receptacle. Screw elements that act on the bit holder can be threaded into the screw receptacle.

Figure 2:
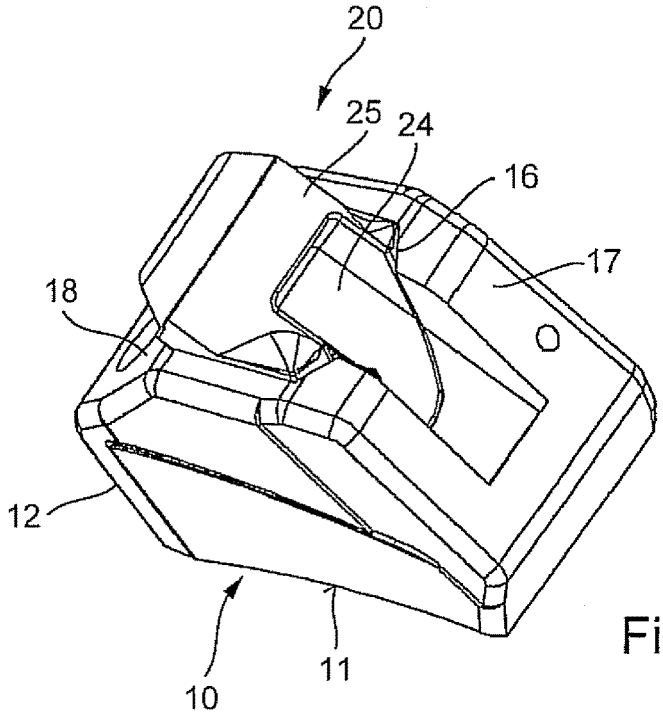
Figure 3:
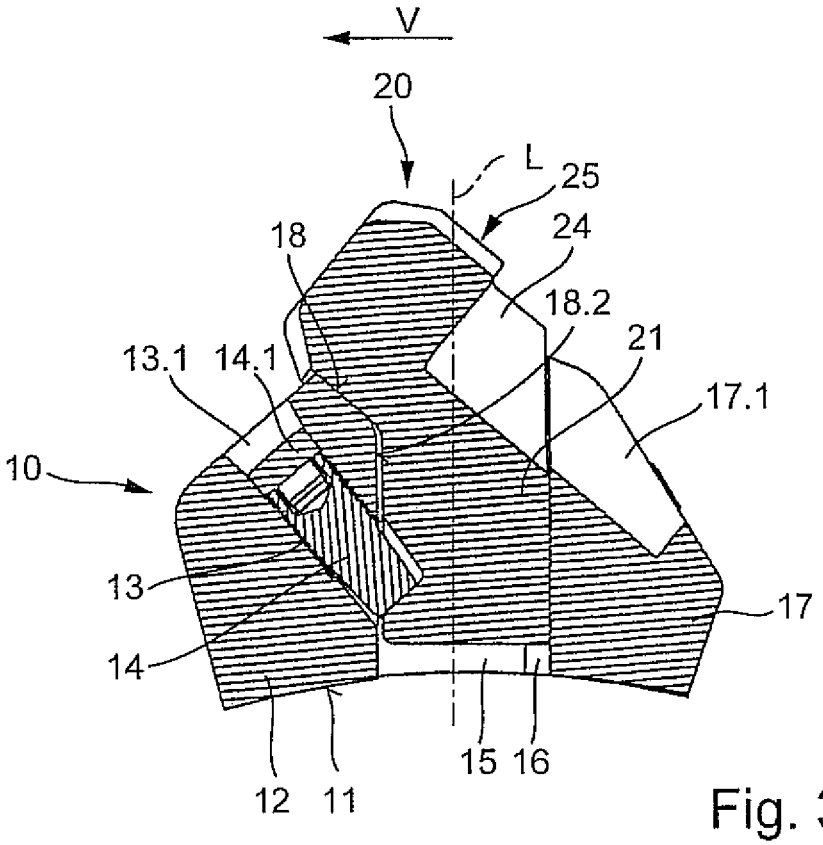
Figure 4:
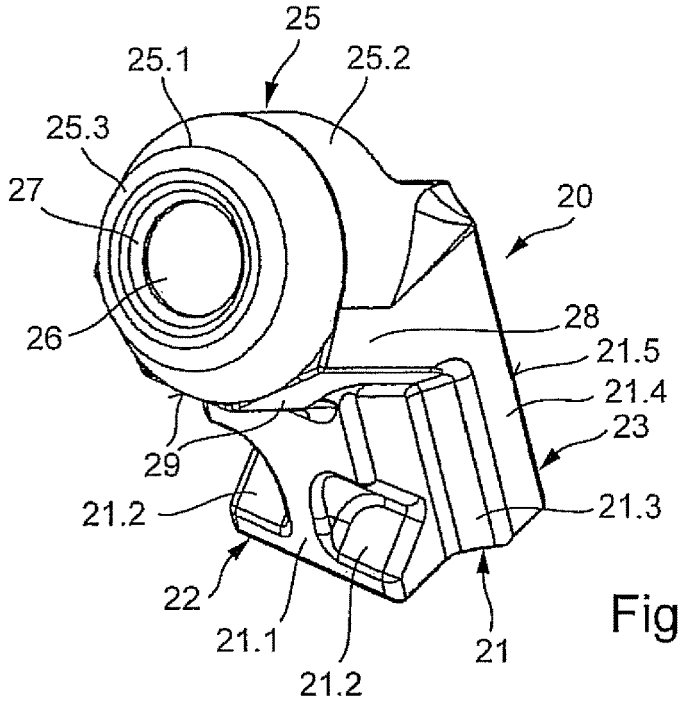
Figure 5:
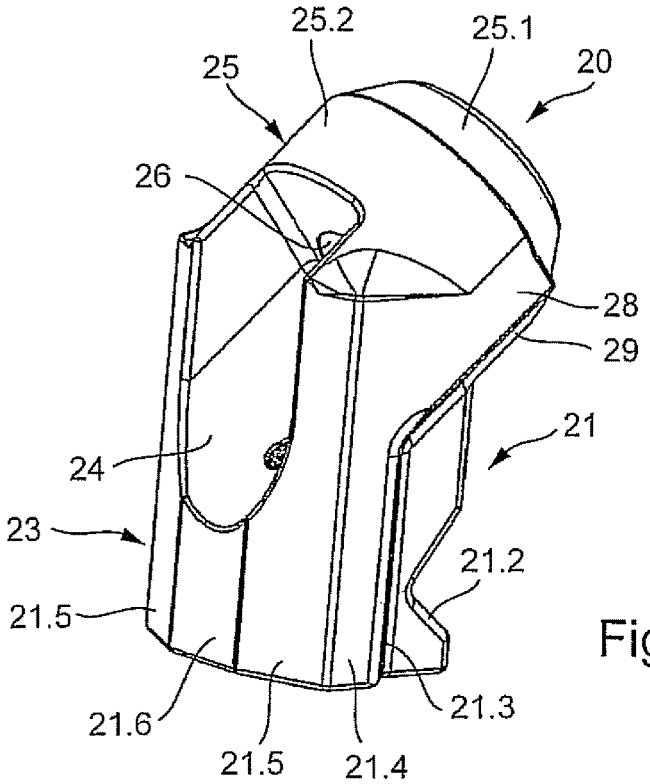
Figure 6:
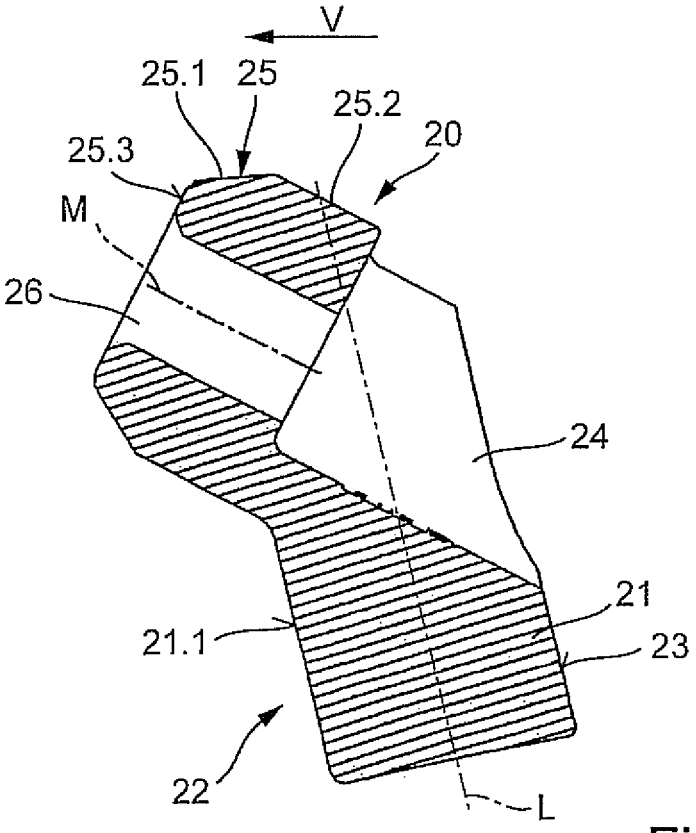
Figure 7:
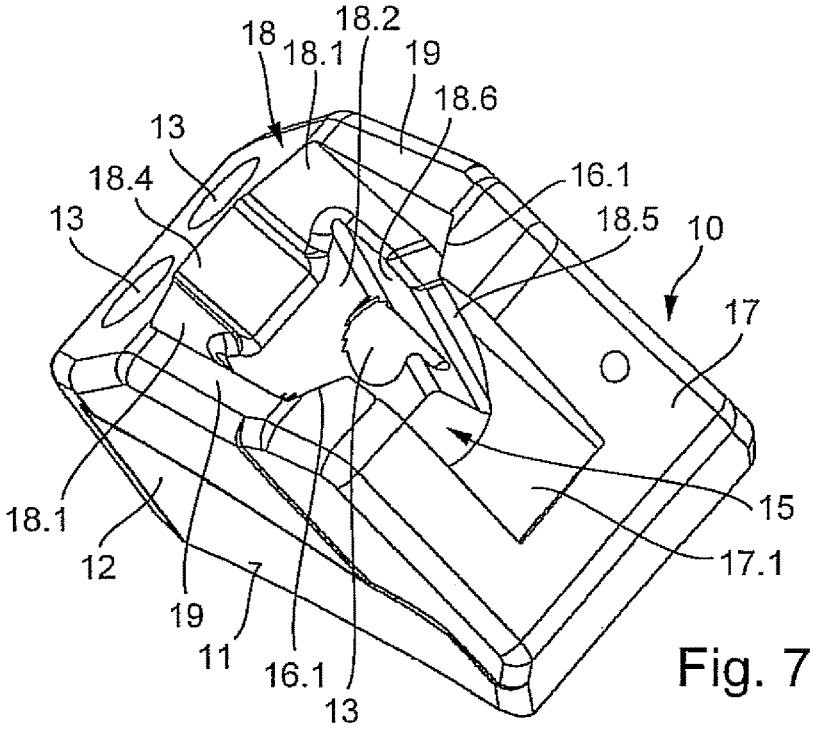

The invention will be explained in more detail below with reference to an exemplifying embodiment depicted in the drawings, in which:

FIG. 1 is a perspective front view of a tool combination having a base part and a bit holder, FIG. 2 is a perspective rear view of the tool combination according to FIG. 1, FIG. 3 is a vertical section through the tool combination according to FIG. 1 or 2, FIG. 4 is a perspective front view of the bit holder in accordance with the tool combination according to FIGS. 1 to 3, FIG. 5 is a rear view of the bit holder according to FIG. 4, FIG. 6 is a vertical section through the bit holder according to FIG. 4 or 5, FIG. 7 is a perspective top view of the base part according to FIGS. 1 to 3, and FIG. 8 is a vertical section through the base part according to FIG. 7.

FIG. 1 shows a base part 10 that has an underside 11 having concavely curved placement surfaces. By means of these placement surfaces, the base part can be placed onto the cylindrical outer enveloping surface of a milling drum and fixedly welded thereonto. A bit holder 20 is joined to base part 10.

As FIG. 3 shows, base part 10 comprises an insertion receptacle 15 that receives an insertion projection 21 of bit holder 20. The configuration of bit holder 20 will be explained in more detail below with reference to FIGS. 4 to 6.

As FIG. 4 shows, bit holder 20 comprises insertion projection 21, onto which a holding projection 25 is attached at an angle. Ideally, an obtuse angle is enclosed between insertion projection 21 and holding projection 25. The holding projection 25 may also be referred to as a supporting projection 25 of the bit holder 20. Insertion projection 21 forms, in the region of its insertion projection front side 22 facing in the tool feed direction (v), a front surface 21.1. Two cutouts are recessed into this front surface 21.1 in such a way that they form pressure surfaces 21.2. Pressure surfaces 21.2 are arranged an angle to the longitudinal axis of insertion projection 21. The protrusion of insertion projection 21 that carries pressure surface 21.2 transitions via lateral transition segments 21.3 into lateral surfaces 21.4. Lateral surfaces 21.4 are aligned in the direction of the tool feed direction (v), and face toward the tool sides. As is evident from FIG. 5, lateral surfaces 21.4 transition in the region of insertion projection rear side 23 into bearing surfaces 21.5. Bearing surfaces 21.5 are at an angle to one another. Bearing surfaces 21.5 are in turn joined by means of a transition surface 21.6, and face oppositely to feed direction v.

Holding projection 25 is equipped with a bit receptacle 26 in the shape of a cylindrical bore. Longitudinal center axis M of bit receptacle 26 and longitudinal axis L of insertion projection 21 ideally enclose an angle in the range between 100° and 160°, preferably 130°. Bit receptacle 26 transitions via an introduction expansion 27 into an abutting surface 25.3. Abutting surface 25.3 extends radially with respect to bit receptacle 26. Facing away from bit receptacle 26, abutting surface 25.3 transitions into a cross-sectional constriction 25.1. Cross-sectional constriction 25.1 is embodied in the shape of a truncated cone and transitions enveloping surface 25.2 of bit holder 20 into abutting surface 25.3. Holding projection 25 comprises, in the region below bit receptacle 26, two supporting surfaces 29 that are incident at a V-shaped angle to one another. As is evident from FIG. 6, because of their oblique incidence, supporting surfaces 29 face toward the free end of the insertion projection and at the same time in the feed direction (v), and (as depicted in FIG. 3) extend parallel or substantially parallel to longitudinal center axis M of bit receptacle 26. As is evident from FIG. 5, holding projection 25 possesses lateral enlargements 28 into which supporting surfaces 29 continue. Supporting surfaces 29 and bearing surfaces 21.5 are oriented so as to face in mutually opposite directions.

Figure 8:
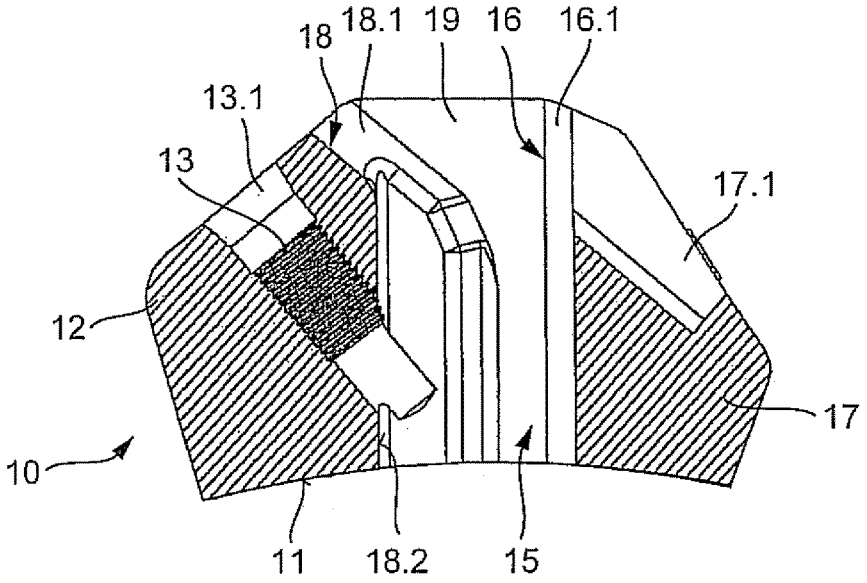

The conformation of base part 10 will be explained in further detail below with reference to FIGS. 7 and 8.

Base part 10 comprises an insertion receptacle 15 that is embodied, in its cross section, in a manner adapted to the outer contour of insertion projection 21 of bit holder 20. On the front side, insertion receptacle 15 is delimited by means of a supporting projection 12. A screw receptacle 13, constituting a thread, is recessed into supporting projection 12. Screw receptacle 13 opens into insertion receptacle 15. Facing away from insertion receptacle 15, screw receptacle 13 continues into a bore expansion 13.1. Supporting projection 12 comprises, in its upper, radially externally located region, an abutment 18 that is formed by two supporting surfaces 18.1. The two supporting surfaces 18.1 are incident at an angle to one another. The angular alignment of supporting surfaces 18.1 is adapted to the alignment of supporting surfaces 29 of bit holder 20, so that supporting surfaces 29 of bit holder 20 can abut in plane-parallel fashion against supporting surfaces 18.1 of base part 10. For the purpose of defined contact of bit holder 20, supporting surfaces 18.1 are joined to one another via a set-back recess 18.4.

Insertion receptacle 15 is delimited on the rear side by a countermember 16. Countermember 16 is part of a rearward projection 17 that protrudes, oppositely to the feed direction (v), beyond insertion receptacle 15. Countermember 16 is constituted by two further supporting surfaces 16.1 that are at an angle to one another. These further supporting surfaces 16.1 are again embodied, in terms of their configuration and spatial arrangement, in a manner adapted to bearing surfaces 21.5 of bit holder 20, thus enabling plane-parallel contact of further bearing surfaces 21.5 against supporting surfaces 16.1. Opposite to supporting surfaces 18.1, insertion receptacle 15 is delimited by an exposed surface 18.2. In the tool feed direction (v), insertion receptacle 15 is delimited by two lateral connecting segments 19. The inner surfaces, which are formed by connecting segments 19 and which face toward insertion receptacle 15, transition via exposed surfaces 18.5 into walls 18.6 that are in turn oriented in the tool feed direction (v). Walls 18.6 in turn continue into exposed surface 18.2. As is clearly evident from FIG. 7, a cutout 17.1 is recessed into projection 17.

Installation of bit holder 20 on base part 10 is performed as follows.

Firstly, bit holder 20 is slid with its insertion projection 21 into insertion receptacle 15 of base part 10. As is evident from FIG. 3, a setscrew, constituting a fastening element 14, is then screwed into screw receptacle 13. Fastening element 14 comprises a compression surface, oriented at right angles to the screw axis, that comes into contact against pressure surface 21.2 of bit holder 20. The compression surface does not need to be a flat surface, but can also be a spherical surface. It is evident from FIG. 1 that two fastening elements 14 are used to fasten tool holder 20, so consequently two screw receptacles 13 are also recessed into base part 10. Upon tightening of fastening elements 14, fastening element 14 presses onto pressure surface 21.2. Because of the angled incidence of pressure surface 21.2 with respect to the longitudinal center axis of insertion projection 21, fastening element 14 exerts a draw-in force on insertion projection 21. At the same time, a force component is generated that extends oppositely to the feed direction (v) and presses insertion projection 21 into countermember 16. The force component extending in the direction of the longitudinal axis of insertion projection 21 brings supporting surfaces 18.1 of abutment 18 into contact against supporting surfaces 29 of bit holder 20. As is clearly evident in particular from FIG. 3, a tightening of fastening elements 14 now causes bit holder 20 to experience bracing on both sides of the longitudinal center axis of insertion projection 21. Bracing is effected on the one hand against countermember 16 in back of the longitudinal center axis at the insertion-projection end of bit holder 20, and on the other hand against abutment 18 in front of the longitudinal center axis at the holding-projection end of the bit holder. Supporting surfaces 29 and bearing surfaces 21.5 on bit holder are consequently located diametrically opposite one another. Fastening screw 14 now acts on insertion projection 21 in such a way that a clamping of bit holder 20 against abutment 18 and against countermember 16 takes place. This guarantees secure and lossproof fastening of bit holder 20.

It is further evident from FIG. 3 that a cover element 14.1, which covers the tool receptacle of fastening element 14, can be inserted into bore expansion 13.1 of screw receptacle 13.

Both base part 10 and bit holder 20 are embodied substantially mirror-symmetrically with respect to the transverse center plane, extending in the feed direction (v), of these respective components. This promotes uniform load dissipation.

During operational use, a point-attack cutting tool of usual construction, inserted into bit receptacle 26, engages into the material to be removed, for example a coal seam. It is principally the bracing system made up of abutment 18 and supporting surfaces 29 that is stressed in the context of this engagement. During tool engagement, bit holder 20 is also pressed into countermember 16 as a consequence of the feed (v). The large-area contact of bit holder 20 at that location guarantees reliable force dissipation.

As is evident from FIG. 3, an unequivocal association between bit holder 20 and base part 10 is guaranteed in particular by the fact that only one abutment takes place at these two aforementioned central supporting points (abutment 18 and countermember 16). In the region of recess 18.4, exposed surface 18.2, walls 18.6, exposed surfaces 18.5, and connecting segment 19, insertion projection 21 is disengaged from insertion receptacle 15. If abrasion of supporting surfaces 18.1, for example, then takes place as base part 10 being used, recess 18.4 thus forms a setback space. The spacing between bit holder 20 and recess 18.4 ensures that bit holder 20 can be reset in the event of wear. Wear compensation can take place in particular because supporting surface 18.1 and further supporting surfaces 16.1 form slide guides on which bit holder 20 can slip upon retensioning. This configuration is advantageous in particular when, as is usually required, base part 10 has a service life that extends over multiple life cycles of bit holders 20. Unworn bit holders 20 can then always be securely clamped and held, even on a partly worn base part 10.

During operational use, removed material that slips off bit holder 20 in the region of enveloping surface 25.2 is cleared by the built-in point-attack bit. This removed material is directed outward via enlargements 28, thereby protecting base part 10 from the abrasive attack of this removed material.

When a point-attack bit is worn, it can easily be replaced. This is possible because cutouts 17.1 in base part 10 form, together with opening 24 in bit holder 20, a tool receptacle. Into this can be inserted an ejector tool that acts on the rear side of the point-attack bit and pushes it out of bit receptacle 26. As is evident from FIG. 5, bit receptacle 26 is spatially connected to opening 24.

The invention claimed is:

1. A tool apparatus, comprising:

an insertion projection having a longitudinal axis, the insertion projection including a bearing segment including at least one bearing surface; and a supporting projection defining a bit longitudinal center axis enclosing an obtuse angle with the longitudinal axis of the insertion projection, the supporting projection including a supporting segment including at least one supporting surface configured to support the supporting projection, the at least one supporting surface facing away from the bit longitudinal center axis;

wherein the longitudinal axis of the insertion projection and the bit longitudinal center axis define a transverse central plane of the tool apparatus;

wherein at least one of the at least one bearing surface and the at least one supporting surface includes two surfaces located on opposite sides of the transverse central plane, the two surfaces being arranged at an angle to each other and thus non-parallel to each other; and wherein the insertion projection includes an insertion projection front side facing in a tool feed direction, and the insertion projection includes on the insertion projection front side at least one pressure surface for impingement with a screw.

2. The apparatus according to claim 1, wherein:

the at least one supporting surface of the supporting segment includes two supporting surfaces located on opposite sides of the transverse central plane, the two supporting surfaces being arranged at an angle to each other and thus non-parallel to each other, and the two supporting surfaces being located in front of the insertion projection in a tool feed direction.

3. The apparatus according to claim 2, wherein:

the at least one bearing surface faces oppositely from the tool feed direction.

4. The apparatus according to claim 3, wherein:

the at least one bearing surface extends parallel to the longitudinal axis of the insertion projection.

5. The apparatus according to claim 1, wherein:

the at least one pressure surface of the insertion projection front side is at an angle to the longitudinal axis of the insertion projection such that a force exerted against the pressure surface forces the insertion projection downward and rearward.

6. The apparatus according to claim 1, wherein:

the insertion projection has a free end, and the at least one supporting surface of the supporting projection faces toward the free end of the insertion projection.

7. The apparatus according to claim 1, wherein:

the supporting projection includes a cantilevered region that is cantilevered out beyond the insertion projection, and the at least one supporting surface is located on the cantilevered region.

8. The apparatus according to claim 1, wherein:

the at least one bearing surface extends in the direction of the longitudinal axis of the insertion projection from a region adjacent the supporting projection to a location beyond the at least one supporting surface of the supporting projection.

9. The apparatus according to claim 8, wherein:

the at least one bearing surface extends parallel to the longitudinal axis of the insertion projection.

10. The apparatus according to claim 1, wherein;

the at least one supporting surface and the at least one bearing surface form slide guides.

11. The apparatus according to claim 1, wherein:

both of the at least one bearing surface and the at least one supporting surface include two surfaces symmetrically located on opposite sides of the transverse central plane.

12. The apparatus according to claim 1, wherein:

an enclosed angle between the at least one supporting surface and the bit longitudinal center axis is in the range of from +20 degrees to −20 degrees.

13. The apparatus according to claim 12, wherein:

the enclosed angle is substantially zero so that the at least one supporting surface is substantially parallel to the longitudinal center axis of the bit receptacle.

14. The apparatus according to claim 12, wherein:

the obtuse angle between the bit longitudinal center axis and the longitudinal axis of the insertion projection is in a range of from 110 degrees to 160 degrees.

15. The apparatus according to claim 1, wherein:

the at least one supporting surface is located diametrically from the at least one bearing surface.

16. A tool apparatus, comprising:

an insertion projection; and a supporting projection, the supporting projection protruding from the insertion projection in a tool feed direction, and the supporting projection including a rigid integral supporting segment including at least one supporting surface arranged in front of the insertion projection in the tool feed direction; and wherein the insertion projection extends from the supporting projection in an insertion direction, and the insertion projection comprises a front side facing in the tool feed direction, the front side including at least one pressure surface arranged at an angle of less than 90 degrees with respect to the insertion direction so that a pressure exerted on the pressure surface will force the insertion projection in the insertion direction and rearward; and wherein the insertion projection comprises an insertion projection rear side facing away from the tool feed direction, the rear side including a further supporting segment including one or more bearing surfaces extending substantially in the insertion direction.

17. The apparatus according to claim 16, wherein the at least one supporting surface of the supporting segment comprises two supporting surfaces that are at an angle to one another.

18. The apparatus according to claim 17, wherein the supporting surfaces are arranged on both sides of a transverse center plane that extends through a longitudinal center axis of the supporting projection and in the insertion direction.

19. The apparatus according to claim 17, wherein the supporting surfaces form a slide guide.

20. The apparatus according to claim 16, wherein the at least one pressure surface is arranged at an angle of less than 80 degrees with respect to the insertion direction.

21. The apparatus according to claim 16, wherein the one or more bearing surfaces include two bearing surfaces at an angle to one another.

* * * * *